US006466170B2

(12) United States Patent
Zhou

(10) Patent No.: US 6,466,170 B2
(45) Date of Patent: Oct. 15, 2002

(54) INTERNAL MULTI-BAND ANTENNAS FOR MOBILE COMMUNICATIONS

(75) Inventor: Guangping Zhou, Lake Zurich, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/819,551

(22) Filed: Mar. 28, 2001

(65) Prior Publication Data

US 2002/0140607 A1 Oct. 3, 2002

(51) Int. Cl.[7] ..... H01Q 1/38
(52) U.S. Cl. ..... 343/700 MS; 343/847
(58) Field of Search ..... 343/700 MS, 847, 343/876, 767, 770, 702

(56) References Cited

U.S. PATENT DOCUMENTS

| | | | | |
|---|---|---|---|---|
| 3,971,032 A | | 7/1976 | Munson et al. | 343/767 |
| 4,531,130 A | | 7/1985 | Powers et al. | 343/767 |
| 4,775,866 A | | 10/1988 | Shibata et al. | 343/700 MS |
| 5,446,471 A | | 8/1995 | Chung et al. | 343/770 |
| 5,463,406 A | | 10/1995 | Vannatta et al. | 343/725 |
| 5,760,745 A | | 6/1998 | Endo et al. | 343/702 |
| 6,133,880 A | * | 10/2000 | Grangeat et al. | 343/700 MS |
| 6,160,513 A | * | 12/2000 | Davidson et al. | 343/700 MS |
| 6,255,994 B1 | * | 7/2001 | Saito | 343/700 MS |
| 6,262,682 B1 | * | 7/2001 | Shibata | 343/700 MS |

* cited by examiner

*Primary Examiner*—Don Wong
*Assistant Examiner*—James Clinger
(74) *Attorney, Agent, or Firm*—Roland K. Bowler, II

(57) ABSTRACT

An internal multi-band antenna (10) for a mobile communication devices having a planar radiating element (12) and a ground plane conductor (14) disposed substantially parallel thereto with a dielectric (16) such as air or a substrate therebetween. The radiating element (12) includes at a feed point, for example, a feeding strap (18), which may have an L-shape. One or more shorting straps (20,22) are selectively connected between the radiating element (12) and the ground conductor (14), positioned relative to the feed point for tuning the input impedance at the feed point, and for tuning the resonant frequency of the planar radiating element (12). The radiating element includes an angled slot (26) having at least three slot sections, for example, N, M, W shapes and the like, mutually coupled at a second resonant frequency to increase resonant frequency bandwidth. The feeding strap (18) and one or more shorting straps may be provided as inverted L straps (30) for a series LC impedance.

19 Claims, 5 Drawing Sheets

INTERNAL MULTI-BAND ANTENNAS FOR MOBILE COMMUNICATIONS

FIELD OF THE INVENTIONS

The present inventions relate generally to antenna devices, and more particularly to internal multi-band slot antennas for mobile communication devices and other compact antenna applications.

BACKGROUND OF THE INVENTIONS

Dual band antennas are used widely in mobile telephones to accommodate different communication standards. Known external dual band antennas, also referred to as stubby antennas, however, tend to exhibit a high Specific Absorption Rate (SAR) compared to other conventional antennas. Additionally, external and retractable antennas are exposed outside the telephone housing, which is inconvenient for the user. Internal antennas have been proposed to replace external and retractable antennas, but conventional internal antenna designs have do not provide adequate bandwidth, especially for dual mode applications.

Patch micro-strip antennas are considered advantageous in several ways because of their compact lightweight structure, which is relatively easy to fabricate and produce with precise printed circuit techniques capable of integration on printed circuit boards. It is desirable in some applications to provide thin antennas capable of operating in multiple bands having the advantages associated with patch antennas, but prior attempts have been unsuccessful. Additionally, known internal patch antennas tend to have a narrow bandwidth, unless a thick dielectric substrate is employed, but the resulting thickness limits use of the antennas in many applications, particularly in handheld mobile communication devices with severe space and weight constraints.

Conventional patch antennas have natural resonant frequencies or modes for RF and microwave applications. However, there are shortcomings when using natural modes for antenna designs. Natural modes are dependent on the shape and size of the patch. Once the dimensions of the antenna are fixed, the resonant frequencies are also fixed. If the size of the antenna is such that the first mode matches the GSM (900 MHZ) frequency, then the second mode will resonate at its third harmonic, 2700 MHZ, which is not recommended for the DCS (1800 MHZ) frequency. Additionally, to generate natural mode resonant frequencies, the size of the antenna must be relatively large. For example, a 900 MHZ rectangular patch antenna is approximately 12 cm when using a half wavelength patch technique. These large dimensions however are unacceptable for most modern cellular telephone devices, which often require that the antenna be less than approximately 4 cm in length.

Slot antennas may also be implemented in a metal planar surface by providing a gap or a slot in the radiating element. Simple resonant slot antenna geometries include half wavelength and quarter wavelength slot antennas, which are provided with a closed-ended slot or an open-ended slot in the radiating element, respectively. Slot antennas, and conventional patch micro-strip antennas, include a dielectric between the radiating element and a conductive ground plane, with the slot antenna driven differentially from an excitation port, which includes an electrical signal feed point. Slot antennas however also tend to have relatively narrow bandwidths.

The conventional planar inverted F antenna (PIFA) includes a planar radiating element and a ground conductor, as discussed in connection with patch microstrip and slot antenna structures. In the inverted F antenna, the radiating element and the ground conductor are parallel flat conductive surfaces with a feed point and a short circuit end, which resonates with an electric wave at a particular frequency, depending on the length of the radiating conductor. Known PIFA antennas have limitations and generally are not suitable for multi-mode and space limited applications. The conventional PIFA antenna is a quarter wavelength long. The specified frequency generally dictates the length or size of the antenna. If one wants to tune the resonating frequency for another application, the size or some other attribute of the antenna, like the dielectric, must be changed.

The various aspects, features and advantages of the present invention will become more fully apparent to those having ordinary skill in the art upon careful consideration of the following Detailed Description of the Invention with the accompanying drawings described below.

DETAILED DESCRIPTION OF THE INVENTIONS

Figure 1:
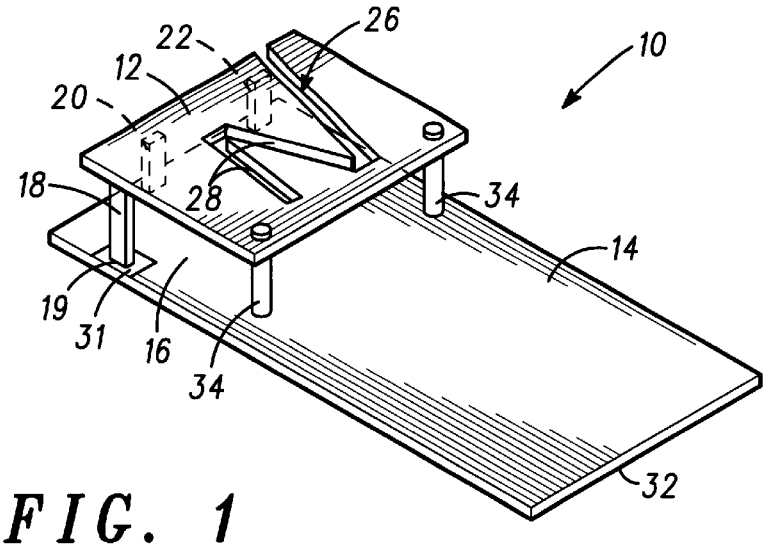
FIG. 1 illustrates an exemplary internal antenna of the present invention.

FIG. 1 is a multi-band antenna for use in mobile communication devices, and is particularly suitable for applications requiring a small form factor, for example cellular telephones and other wireless enabled mobile communication devices.

In one embodiment, the multi-band antennas described herein accommodate two or more distinct frequency bands of operation with a single excitation port. The multi-band antenna devices employ shorting straps and a slot to generate multi-band band frequencies with a size and weight much smaller than conventional antennas. An exemplary embodiment described herein generates GSM 900 MHZ frequency and DCS 1800 MHZ frequency, as discussed more fully below.

FIG. 1 illustrates an internal multi-band antenna comprising generally a substantially planar radiating element 12 and a substantially planar ground conductor 14 disposed substantially parallel to the radiating element 12 to serve as a ground plane. In one embodiment, the ground conductor 14 is a conductive material disposed on a portion of a printed circuit board 32.

A dielectric 16 is disposed between the radiating element and the ground conductor. In FIG. 1, the exemplary dielectric 16 is an air gap. Alternatively, the dielectric may be some other material, formed for example as a substrate, between the radiating element and the ground conductor. Where the dielectric 16 is an air gap, plastic supports or some other offsets 34 may position the radiating element 12 relative to the ground conductor 14 or the printed circuit board 32.

At least one shorting strap is positioned relative to an electrical signal introduction feed point on the radiating element. The one or more shorting straps generally interconnect the radiating element and the ground conductor. In FIG. 1, there are two shorting straps 20 and 22 for multi-band operation and in other embodiments there may be additional shorting straps, at least one of which interconnects the radiating element and the ground conductor, as discussed more fully below. The shorting straps are generally located different distances from the feed point.

In FIG. 1, the feed point comprises a feeding strap 18 having one end coupled to the radiating element 12. Another portion or end 19 of the feeding strap 18 is coupled to electrical circuitry by a conductive lead, not illustrated in the drawing. IN the exemplary embodiment, the end 19 is the feed point. The feeding strap 18 is not connected to the ground conductor. In the exemplary embodiment of FIG. 1, there is a non-conductive area 31 on the printed circuit board where the feeding strap contacts the circuit board 32. The conductive lead coupled to the feed point may for example be disposed in a layer of the printed circuit board below the ground conductor.

Figure 3:
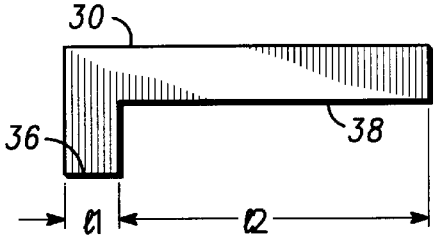
FIG. 3 illustrates a L-shaped conductive member suitable for use as a shorting or feeding strap.

In one embodiment, illustrated in FIG. 3, the feeding strap and/or one or more of the shorting straps are L-shaped members. The L-shaped member may be configured to provide a particular impedance, for example a capacitance or a capacitance in series with an inductance, depending on its configuration, as discussed more fully below.

Figure 2:
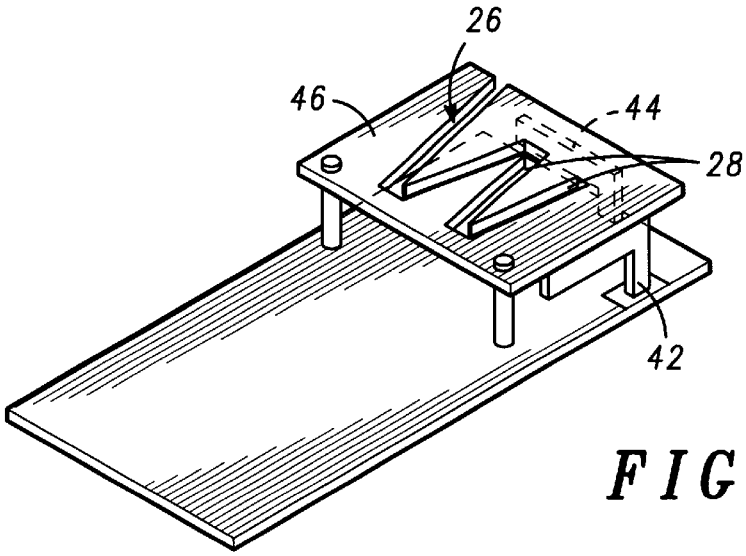
FIG. 2 illustrates another exemplary internal antenna of the present invention.

In FIG. 1, an angled slot 26 is disposed on the radiating element 12. The angled slot is partitioned into at least two segments or sections 28 preferably arranged at acute angles relative to one another. Preferably, the angled slot is partitioned into at least three slot sections 28. Exemplary angled slot configurations include forms with a Z or N or M or W shape or other acute angle shapes or combinations thereof. FIG. 2 illustrates another acute angled slot having a W-shaped configuration.

Generally, the acutely angled slot facilitates mutual coupling between the sections thereof at resonant frequencies, which increase the bandwidth of the antenna. In the exemplary embodiments, the Z, N, M and W shaped slots with acute angles between adjacent corresponding sections provide good mutual coupling among all the sections, i.e., first to second, second to third, and first to third sections, etc. Slots having sections arranged at right and oblique angles may not exhibit good magnetic coupling between adjacent sections and provide limited mutual coupling between adjacent sections. While the right and oblique slot configurations may be suitable for some applications, acute angled slots having three or more sections are preferred, especially for multi-band applications.

Multi-mode operation is provided by selectively connecting one or more of a plurality of shorting straps between the radiating element and the ground conductor, thereby tuning the input impedance of the antenna, as discussed more fully below. In the exemplary embodiment of FIG. 1, the first shorting strap 20, located closer to the feed point, provides 50 ohm matching ($Z_{in}$) and keeps the antenna size small, while the second shorting strap 22 located farther from the feed point tunes the GSM 900 frequency.

Figure 4:
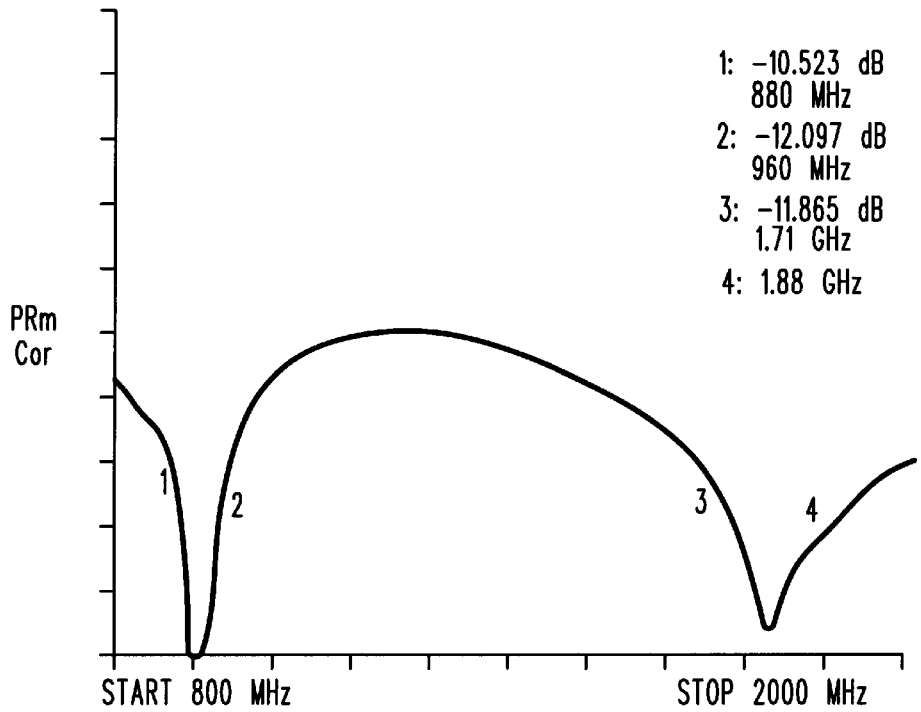
FIG. 4 illustrates return loss of the exemplary antenna of FIG. 1.

In FIG. 1, the acute angled slot 26 on the radiating element tunes the GSM 1800 frequency. Generally, changing the length and shape of the angled slot 26 on the radiating element changes the resonating frequency of the higher bands, and changing the distance between the feeding point to the second shorting strap 22 changes the resonant frequency of the lower bands. A typical size of the antenna is approximately 4 cm×2.5 cm×0.7 cm. FIG. 4 illustrates the return loss of the antenna device 10 of FIG. 1, wherein the antenna has dual resonant frequencies at 900 MHZ and 1800 MHZ.

Figure 6:
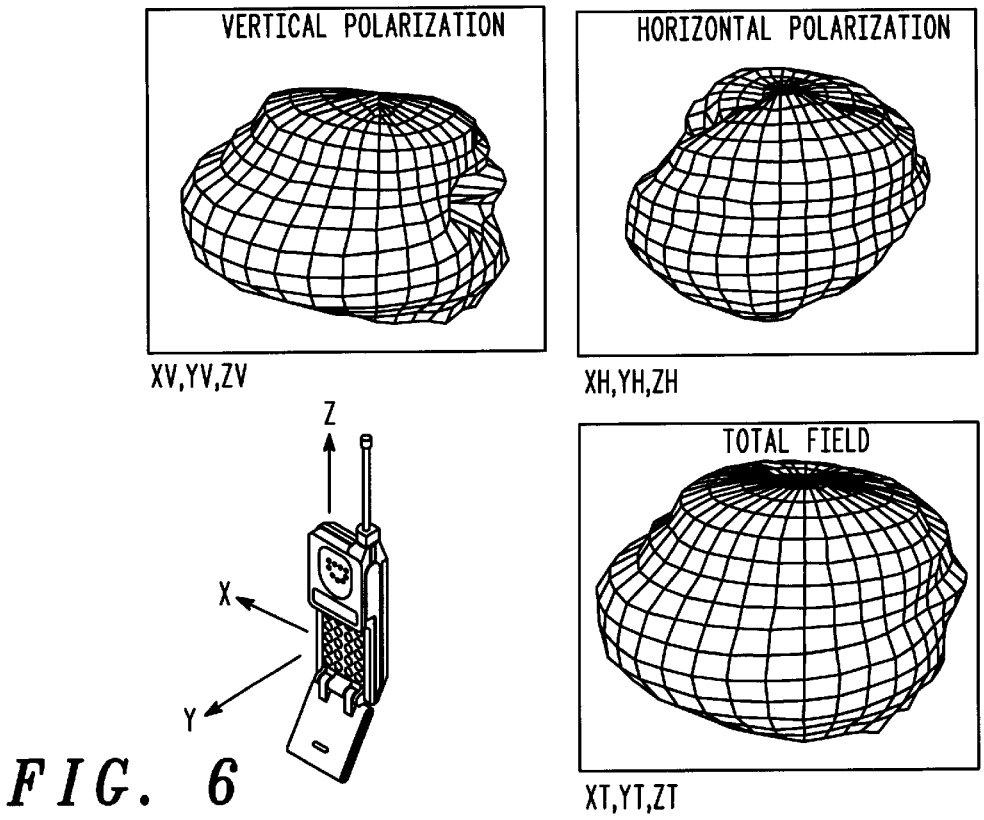
FIG. 6 illustrates three-dimensional radiation patterns of internal antennas in accordance with the invention.
Figure 7:
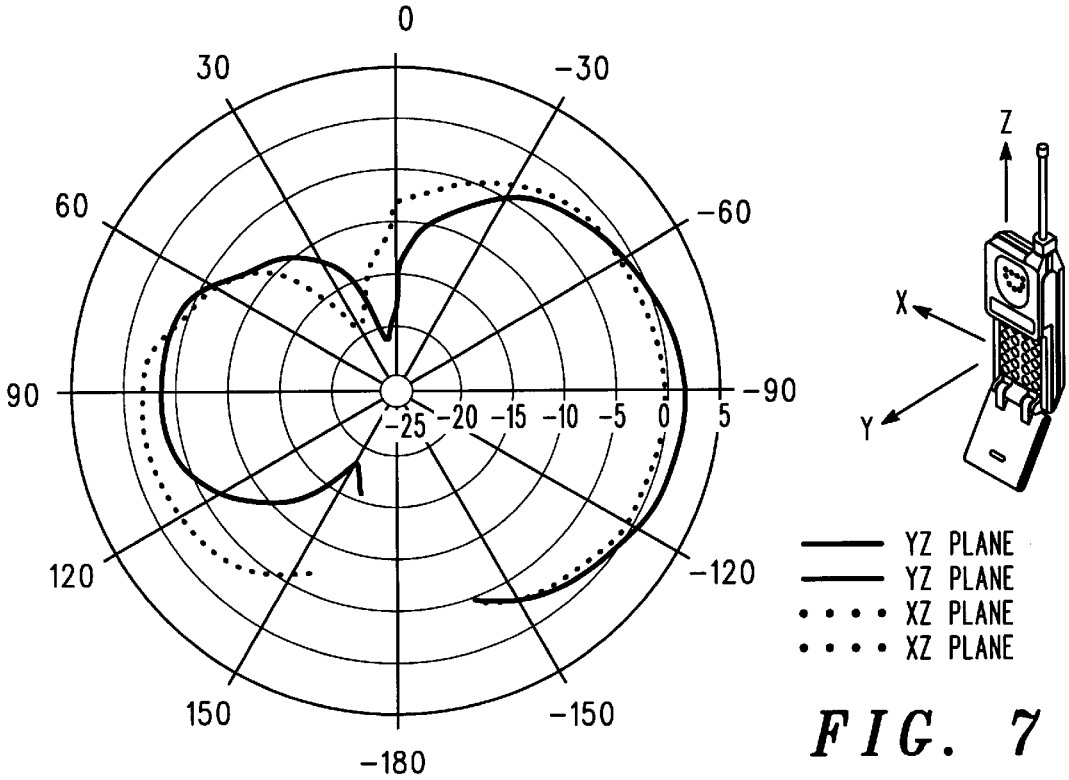
FIGS. 7 and 8 illustrate vertical cuts of the radiation pattern.
Figure 8:
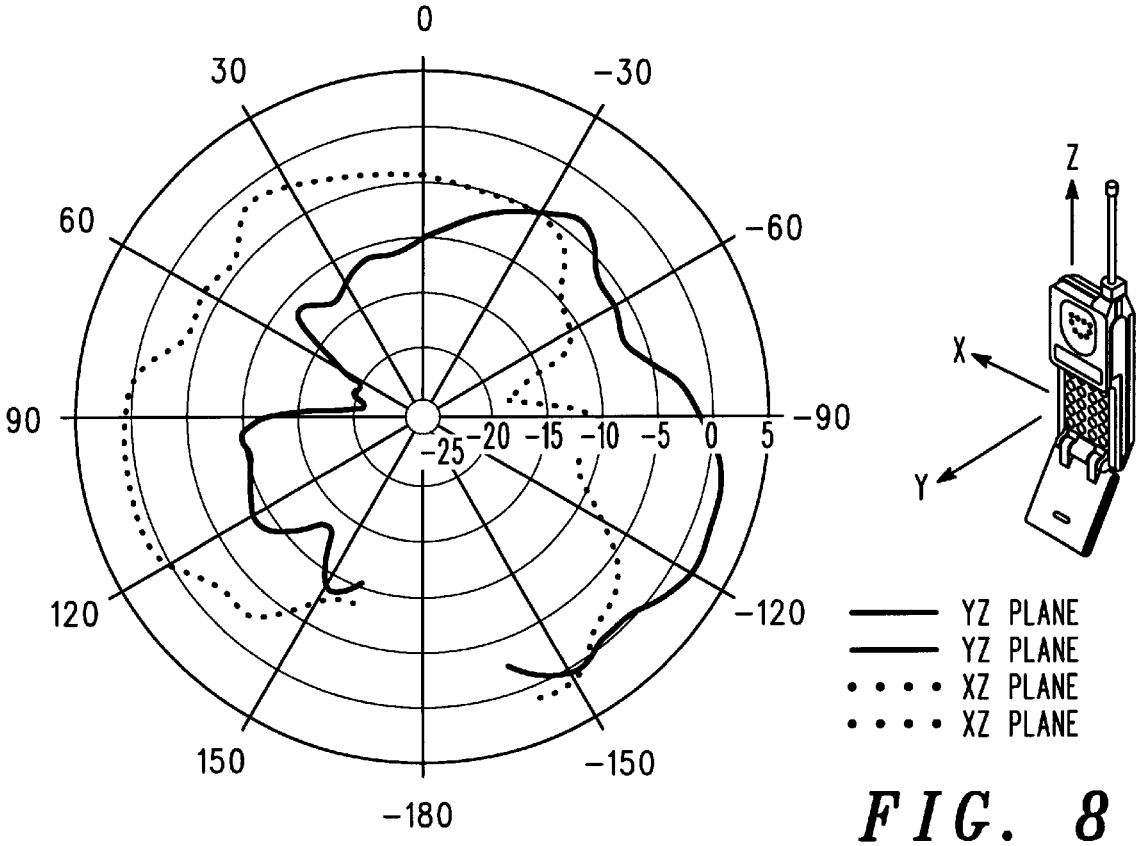

FIG. 6 illustrates 3D radiation patterns of an exemplary internal antenna. The radiation efficiencies for both bands are about 70%. FIGS. 7 and 8 are vertical cuts of the radiation patterns. It will be appreciated by those of ordinary skill in the art that the maximum gain is approximately 1.5 dbi for GSM 900 and approximately 2.5 dbi for GSM 1800. The radiation for both bands is directional. The radiation at the radiating element has approximately 5 db more gain than the radiation at the ground conductor or plane. When the ground plane is placed against the user's head, it will have much smaller SAR than a stubby antenna or any other omni-directional antenna.

The shorting straps and slot are used generally to generate multi-band frequencies so that the size of the antenna is much smaller than conventional antennas. In one embodiment, the shorting straps generate GSM 900 MHZ frequency and the slot generates DCS 1800 MHZ frequency.

GSM 900 MHZ frequency is tuned by two shorting straps positioned relative to a feeding strap. Shorting straps are used instead of pins, which are used in PIFA antennas. The shorting pin, a coaxial pin, and the radiation element make up a PIFA antenna. The shorting straps and the feeding strap of the present invention provide more bandwidth than the shorting and coaxial feeding pin in PIFA antennas. Shorting straps permit the antenna to resonate based on the position of the straps instead of the natural modes.

In the present inventions, the size of the antenna does not need to be changed for the tuning frequency, and the feed point remains fixed. The distance between the feed point and the shorting strap determines the tuning frequency. By changing the distance of the shorting straps relative to the feeding strap 18, for example by selectively interconnecting one or more of the plurality of shorting straps therebetween by closing corresponding switches in series therewith, the resonant frequency of the antenna changes without altering the size of the antenna. For applications in which the antenna will not be used for more than one mode, one shorting strap may be suitable. The distance of this single shorting strap to the feed point is about the average distance of the two shorting straps, for example shorting straps 20 and 22 in FIG. 1.

For cost reduction, in some applications, industry desires a common platform design, which means using the same antenna structure for several telephones and applications. For example, the same internal antenna could be used for dual band AMPS (800 MHz) and PCS (1900 MHz) in North America, or dual band GSM (900 MHz) and DCS (1800 MHz), or tri-band GSM, DCS, PCS, or quad-band AMPS, GSM, DCS, PCS. To provide this multi-platform flexibility, two or three or four shorting straps are provided with a corresponding switch, for example, an RF diode, connected in series between the radiating element and ground conductor, as illustrated in FIG. 3. Alternatively, any other electrically controllable switch may be used.

Using biased RF diodes for switching multiple shorting straps with a control device, for example a microprocessor via I/O ports, generates high or low voltage switching levels. One of the shorting straps is interconnected between the radiating element and ground conductor by closing the corresponding diode switch while the switches of other shorting straps remain open, which allows the antenna to operate in different frequency bands for different applications or platforms. The biased RF diodes can be used as RF switches that switch the shorting straps on (connected) or off (disconnected). With different combinations of individual switches on or off, the antenna may be tuned to specific frequencies as desired.

Figure 5:
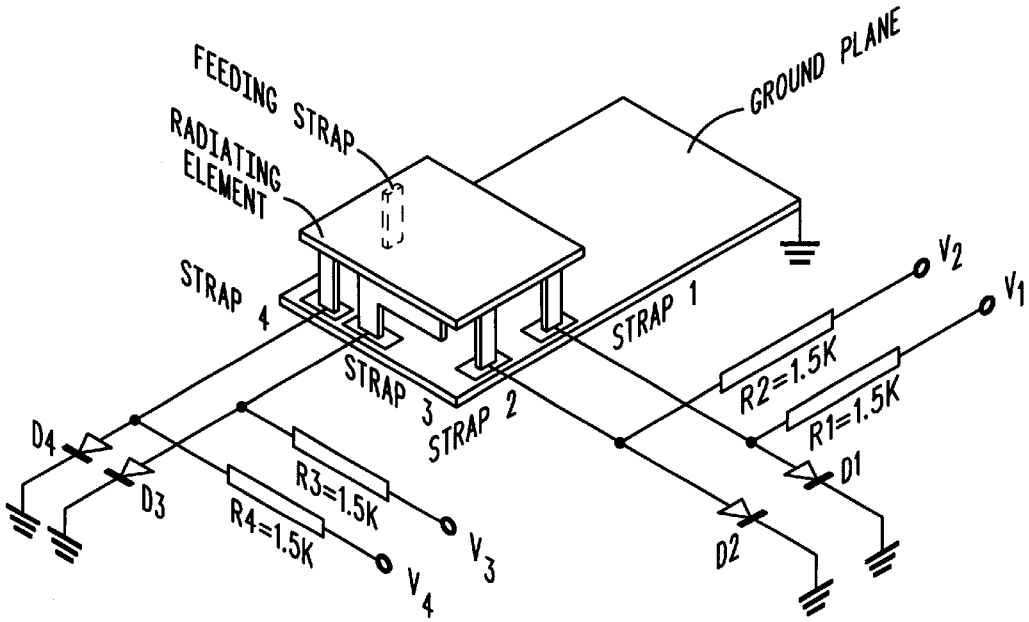
FIG. 5 illustrates a switching concept for an internal multi-band antenna.

In FIG. 5, for example, straps 2 and 3 may be connected for AMPS and PCS dual band applications by turning diodes 2 and 3 on and turning diodes 1 and 4 off. The diode switches may be actuated applying high voltages on the resistors R2 and R3, low voltages on R1 and R4, where R1, R2, R3, and R4 are biasing resistors. By providing four pre-designed straps on the antenna, with the high and low voltages controlling the diode switches, the antenna may be configured by software control to resonate at the frequency bands desired.

Generally, the length of the slot, determined by summing the segment lengths, determines the resonant frequency. To tune the frequency, one needs to change only the length of the slot. If the second frequency band is used for PCS 1900 MHZ, providing a slot about 4 mm shorter will allow the second resonating frequency to shift from 1800 MHZ to 1900 MHZ. As discussed, the shape of the slot can be used to broaden the bandwidth of the antenna, for example by using one or more of the exemplary Z, N, M, or W shapes.

In FIG. 2, an L-shaped feeding and shorting straps 42 and 44 provide an LC resonator with series capacitive and inductive elements. In FIG. 3, the L-shaped strap 30 has a narrow 11 dimension 36 and an elongated or wide 12 dimension 38, which may be varied to provide different impedance characteristics. As discussed, the impedance characteristics of the L-shaped straps also facilitate a widening of the bandwidth operating characteristics of the antenna.

Figure 9:
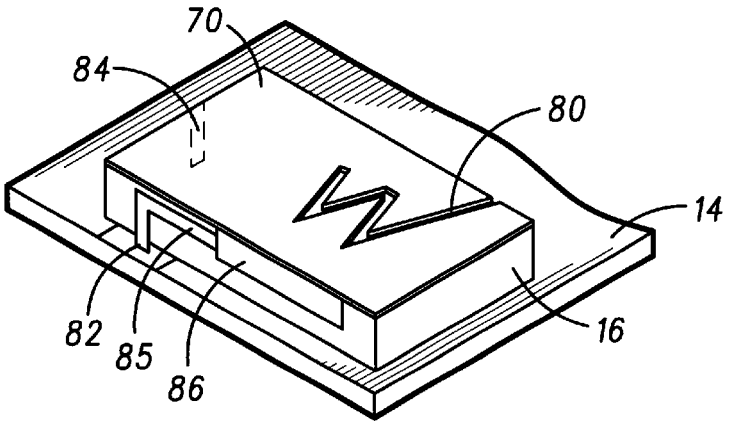
FIG. 9 illustrates inverted L feeding at a feed point feeding strap of an antenna in accordance with the present invention.

GSM 900 MHZ bandwidth may be broadened with a modified L-shaped feeding strap, as illustrated in FIG. 9. The modified feeding strap comprises an L-shaped member having a long leg with a wide upper portion 86 and narrow lower portion 85. A short leg 82 extends from the narrow lower portion 85 of the long leg. The wide upper portion 86 of the long leg is coupled to the radiating element 70, which includes a slot 80. The narrower lower portion 85 of the long leg is spaced apart from the radiating element 70. The short leg 82 extends generally toward the ground plane conductor 14 but is not electrically connected thereto. The shorting strap 84 may also be configured having an L-shape.

The large portion 86 of the feeding strap is equivalent to a capacitive element. When this capacitor is series connected with an inductor, the series LC configuration will generate another resonating frequency that parasitically adds on the first antenna resonating mode. The parasitic mode makes the antenna bandwidth wider. The modified L-shaped feeding strap provides the flexibility to adjust the proper amount of inductance L and capacitance C for resonance by changing the dimensions thereof. For example, varying the length of the portion 85 varies the inductance L, and varying the length and width of the portion 86 varies the capacitance C. When the length of the portion 85 becomes very small, the structure of FIG. 9 becomes the L-shaped structure of FIG. 3. The structure of FIG. 9 is useful for thin antenna designs.

Industry demands thin antenna designs with small distances between the radiating element and the ground plane conductor. As noted a typical shortcoming of the known thin antenna designs is narrow bandwidth. Toward that end, antenna engineers have always strived to trade off between the bandwidth and the thickness of the antenna. The modified L-shaped feeding strap structure of FIG. 9 provides good bandwidth without losing the advantages of a small thickness dimension.

Figure 10:
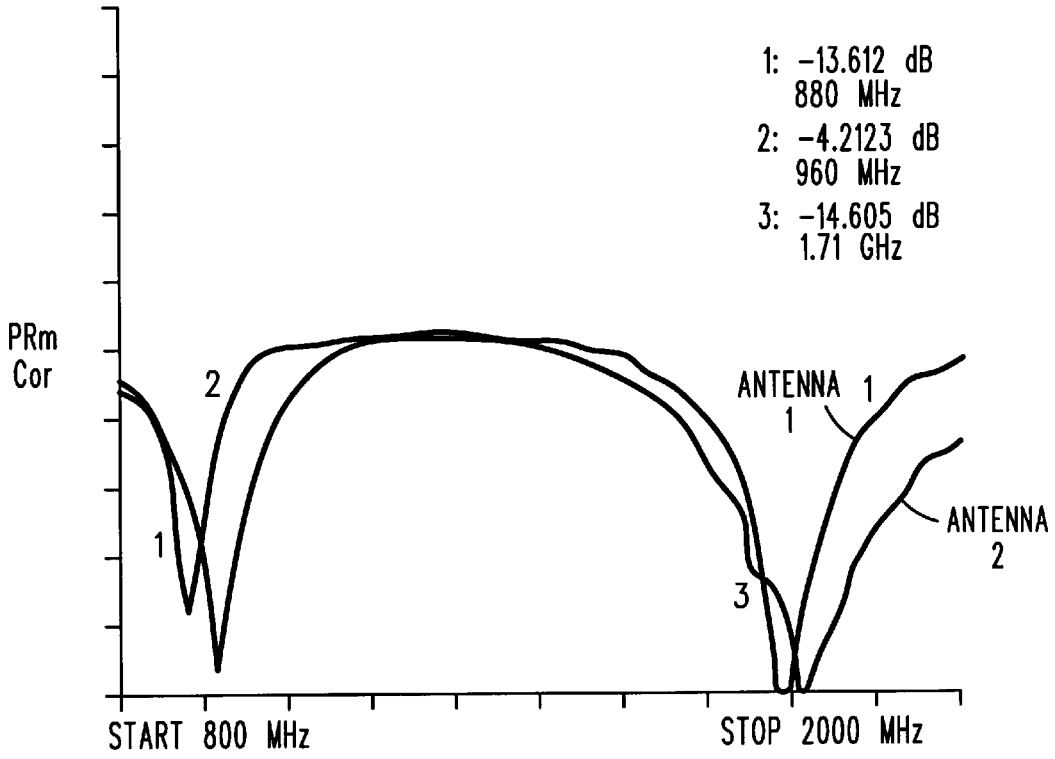
FIG. 10 graphically illustrates measurements and comparisons of two slotted dual band internal antennas.

FIG. 10 illustrates the measurements and comparisons of the two-slotted dual band internal antennas. Curve 1 is measured from a prior art antenna with a straight shorting pin and straight slot. Curve 2 is measured from an antenna of the present invention with a modified L-shaped feeding strap and an angled slot. The GSM 900 MHZ and DCS 1800 MHZ band of the antenna 2 are wider than those of the antenna 1. The wider bandwidth for GSM results from the modified L-shaped feeding strap and the wider bandwidth for DCS results from the angled slot.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

What is claimed is:

1. An antenna device, comprising:

a substantially planar radiating element;

a substantially planar ground conductor disposed adjacent the radiating element;

a dielectric disposed between the radiating element and the ground conductor;

an electrical signal feed point at the radiating element;

a shorting strap connecting the radiating element with the ground conductor; and an acute angled slot formed in the radiating element, the acute angled slot having at least three slot sections, each slot section arranged at an acute angle relative to at least one other slot section.

2. The antenna device of claim 1, the ground conductor disposed substantially parallel with the radiating element.

3. The antenna device of claim 2, the ground conductor comprising at least a portion of a printed circuit board.

4. The antenna device of claim 1, the dielectric comprising a dielectric substrate between the radiating element and the ground conductor.

5. The antenna device of claim 1, the feed point comprising an electrical signal feeding strap coupled to the radiating element.

6. The antenna device of claim 5, a plurality of at least two shorting straps, each shorting strap coupled in series with a corresponding switch between the radiating element and the ground conductor, the plurality of shorting straps located different distances from the feed point, whereby an electrical signal introduction feed point is tuned by closing at least on one of the switches of a corresponding shorting strap to interconnect the radiating element and grounding conductor.

7. The antenna device of claim 1, a plurality of at least two shorting straps, each shorting strap coupled in series with a corresponding diode switch between the radiating element and the ground conductor.

8. The antenna device of claim 5, the feeding strap comprises a capacitive and inductive load.

9. The antenna device of claim 5, the feeding strap comprising an L-shaped member having a long leg with upper and lower portions and a short leg extending from the lower portion of the long leg, the upper portion of the long leg coupled to the radiating element, the lower portion of the long leg spaced apart from the radiating element, the short leg extending generally toward the ground conductor.

10. The antenna device of claim 1, a feeding strap comprising an L-shaped member having a long leg and a short leg portion, at least a portion of the long leg coupled to the radiating element.

11. The antenna device of claim 10, the long leg has a relatively narrow lower portion and a relatively wide upper portion, the short leg portion extending from the lower portion toward the grounding conductor.

12. The antenna device of claim 1, the acute angled slot comprising a slot including the form of one of a Z, N, M, or W.

13. The antenna device of claim 5, the feeding strap comprises a capacitive and inductive load.

14. An antenna device, comprising:

a planar radiating element;

a radiating element ground plane conductor disposed substantially parallel with the radiating element;

a dielectric between the radiating element and the ground conductor;

a feeding strap coupled to the radiating element;

a plurality of at least two shorting straps, the plurality of shorting straps located different distances from where the feeding strap is coupled to the radiating plane, the feeding strap and the plurality of at least two shorting straps located in any combination along at least two different side portions of the antenna.

15. The antenna device of claim 14, each shorting strap coupled in series with a corresponding switch between the radiating element and the ground plane conductor.

16. The antenna device of claim 14, an acute angled slot disposed in the radiating element, the feeding strap having an impedance load in the form of a capacitance in series with an inductance.

17. The antenna device of claim 14, the feeding strap comprising an L-shaped member having a long leg with a wide upper portion and narrow lower portion and a short leg extending from the narrow lower portion of the long leg, the upper portion of the long leg coupled to the radiating element, the lower portion of the long leg spaced apart from the radiating element, the short leg extending generally toward the ground plane conductor.

18. A method of resonating an antenna at least two frequencies, comprising:

resonating the antenna at a resonant frequency by introducing an electrical signal at a feed point on a planar radiating element separated from a ground plane conductor by a dielectric;

tuning an electrical signal impedance at the feed point by positioning a shorting strap interconnecting the radiating element and the ground plane conductor relative to the feed point;

the radiating element having a slot with at least three sections, each section arranged at an acute angle relative to at least one other section, mutually coupling sections of the slot in the radiating element at a second resonant frequency.

19. The method of claim 18, the antenna comprising a plurality of shorting straps each connected in series with a corresponding switch between the radiating element and the ground plane conductor, positioning the shorting strap by closing a switch of at least one of the plurality of shorting straps while the switches of other of the plurality of grounding straps remain open.

* * * * *